US005370543A

United States Patent [19]

Hamada et al.

[11] Patent Number: 5,370,543

[45] Date of Patent: Dec. 6, 1994

[54] ELECTRICAL CONNECTOR

[75] Inventors: Atsushi Hamada; Taketaro Doi, both of Tokyo; Moritaka Gotoh, Chiba; Takeshi Hasegawa, Tochigi, all of Japan

[73] Assignees: Fujikura Ltd., Tokyo; Contec Ltd., Sagamihara, both of Japan

[21] Appl. No.: 71,274

[22] Filed: Jun. 4, 1993

[30] Foreign Application Priority Data

Jul. 24, 1992 [JP] Japan ..... 4-198835

[51] Int. Cl.[5] ..... H01R 31/08

[52] U.S. Cl. ..... 439/188; 439/352; 439/489

[58] Field of Search ..... 439/188, 489, 490, 352

[56] References Cited

U.S. PATENT DOCUMENTS 4,894,019 1/1990 Howard .
5,041,017 8/1991 Nakazato et al. .
5,131,865 7/1993 Taguchi et al. .

FOREIGN PATENT DOCUMENTS 0367173 5/1990 European Pat. Off. ..... 439/188
0146307 3/1991 European Pat. Off. .
3274687 12/1991 Japan .
412478 1/1992 Japan .
412479 1/1992 Japan .

*Primary Examiner*—Z. R. Bilinsky

*Attorney, Agent, or Firm*—Oblon, Spivak, McClelland, Maier, & Neustadt

[57] ABSTRACT

An electrical connector is disclosed which includes first and second connector housings for holding first and second terminals, respectively, a short-circuiting element accommodated in the first housing in electrical contact with two first terminals, a sliding element arranged on the second housing, and an urging element for urging the sliding element in a direction forward from the second housing. The first housing includes a pair of resiliently-deformable engaging arms each having an engaging protrusion. The second housing, releasably fitted to the first housing, includes a pair of first guide grooves for receiving the engaging arms. Each first guide groove has an engaging portion with which the engaging protrusion is held in engagement and a stepped wall portion formed adjacent to the front end of the second housing. The sliding element has a front tongue engageable with the short-circuiting element to disengage the same from the two first terminals. The engaging arms and the first guide grooves are constructed so that upon fitting of the connector housings, the engaging arms are resiliently deformed by the stepped wall portions to be brought into abutment with the sliding element to move the same towards the rear end of the second housing, whereas upon completion of the fitting, the engaging arms are restored to a released position where the engaging protrusions are held in engagement with the engaging portions of the first guide grooves, while permitting the sliding element to move in a direction forward from the second housing.

12 Claims, 7 Drawing Sheets

ELECTRICAL CONNECTOR

BACKGROUND ART

The present invention pertains to an electrical connector which is capable of detecting a fitting of male and female connector housings.

FIG. 12 depicts a conventional electrical connector of the aforesaid type which may be used in an air bag system of an automobile for the protection of the drivers. The conventional electrical connector includes a first connector housing 100 for holding a male terminal 101, and a second connector housing 102 for holding a female terminal 103, the second connector housing 102 being fitted with the first connector housing 100, with the male terminal 101 being connected with the female terminal 103. A short-circuiting terminal 104 of a ring shape is arranged in the second connector housing 102 in electrical contact with the female terminal 103 therein, whereas an insulating elongated tongue 105 is formed integrally on the first connector housing 100.

In the conventional electrical connector thus constructed, as the second connector housing 102 is fitted with the first connector housing 100, the male terminal 101 in the first connector housing 100 is brought into electrical contact with the female terminal 103 in the second connector housing 102, whereas the insulating tongue 105 is inserted between the short-circuiting terminal 104 and the female terminal 103 to disengage the short-circuiting terminal 104 from the female terminal 103. The completion of the fitting of the first and second housings, that is, the completion of electrical connection, is confirmed by detecting such a disengagement of the short-circuiting terminal.

In the aforesaid conventional connector, however, the first and second connector housings 100 and 102 may become loose or become disengaged from each other due to vibration or the like because no special means is provided to prevent the disengagement. Furthermore, before the connection of the male and female terminals is completed, the insulating tongue 105 may be inserted between the short-circuiting terminal 104 and the female terminal 103, and a signal indicating the completion of the fitting of the connector housings may be generated. In such a case, the fitting operation may be stopped based on such a signal, and the connection of the male and female terminals remain uncompleted. In view of these problems, the conventional connector has not been suitable for use in apparatuses which require reliability of a higher level.

SUMMARY OF THE INVENTION

It is therefore the object of the present invention to provide a novel electrical connector which neither becomes loose nor becomes disengaged, and which reliably produces a signal indicating the fitting of the connector housings only when the fitting of the connector housings is actually completed, to thereby avoid insufficient connection and ensure higher reliability.

According to the present invention, there is provided an electrical connector which comprises a first connector housing for holding a plurality of first electric terminals, and a second connector housing for holding a plurality of second electric terminals. The first connector housing has front and rear ends and includes at least one resiliently-deformable engaging arm provided thereon so as to extend forward thereof, the engaging arm having an engaging protrusion at the forward end thereof. The second connector housing has front and rear ends and is releasably fitted to the first connector housing with the second terminals being held in electrical contact with the first terminals, respectively. The second connector housing includes at least one first guide groove formed therein for receiving the engaging arm. The first guide groove has an engaging portion with which the engaging protrusion is held in engagement and a stepped wall portion formed adjacent to the front end of the second connector housing. A short-circuiting element is accommodated in the first connector housing in electrical contact with at least two of the first terminals to connect the two first terminals, and a sliding element is arranged on the second connector housing so as to be slidable in the forward and rearward direction of the second connector housing. The sliding element has a front tongue engageable with the short-circuiting element to disengage the short-circuiting element from the two first terminals. In addition, an urging element is disposed between the sliding element and the second connector housing for urging the sliding element forward from the second connector housing. Moreover, the engaging arm and the first guide groove are constructed so that upon fitting of the first and second connector housings, the engaging arm is resiliently deformed by the stepped wall portion of the first guide groove to be brought into abutment with the sliding element to thereby move the sliding element towards the rear end of the second connector housing, whereas upon completion of the fitting of the first and second connector housings, the engaging arm is restored to a released position where the engaging protrusion is held in engagement with the engaging portion of the first guide groove, while permitting the sliding element to move forward of the second connector housing.

In the electrical connector thus constructed, the fitting operation is proceeded until the disconnection of the short-circuiting element is detected by a detecting device, and when the disconnection of the short-circuiting element is detected, the fitting of the first and second connector housings has already been completed, so that incomplete fitting is reliably avoided. Accordingly, the completion of the first and second connector housings is ensured, and high reliability is achieved.

In addition, the fitting of the first and second connector housings is incomplete until the engaging portions of the engaging arms are held in the engaging portions of the second connector housing, and the moment the engaging portions of the engaging arms are held in engagement with the engaging portions of the second connector housing, the completion of the fitting can be detected. Therefore, the fitting operation is prevented from being stopped during the time in which the fitting is not actually completed.

Accordingly, the electrical connector of the invention can be successfully used to connect electric wires or cables to transmit actuating signals in an air bag system of an automobile for the protection of the drivers.

DETAILED DESCRIPTION OF THE PREFERRED EMBODIMENTS

Figures 1, 8:
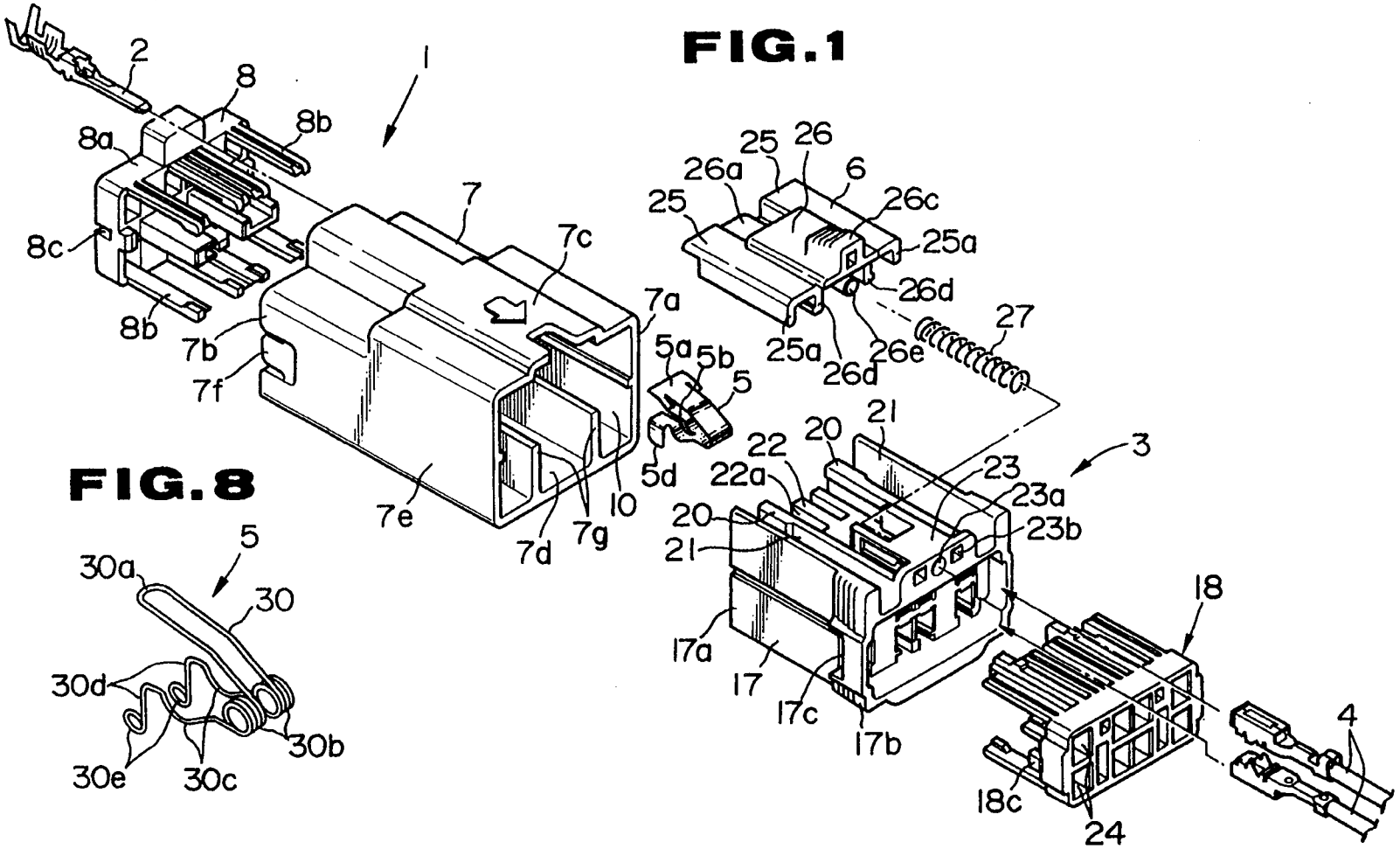
FIG. 1 is a perspective view of an electrical connector in accordance with a preferred embodiment of the present invention.
FIG. 8 is a perspective view showing a modified short-circuiting terminal.

FIGS. 1 to 7 depict an electrical connector in accordance with a first preferred embodiment of the present invention, which comprises a first connector housing 1 for holding a plurality of male (first) electric terminals 2, a second connector housing 3 for holding a plurality of female (second) electric terminals 4, the second connector housing 3 being releasably fitted to the first connector housing 1 with the female terminals 4 being held in electrical contact with the male terminals 2, a short-circuiting terminal or element 5 accommodated in the first connector housing 1, and a lock-confirming sliding element 6 arranged on the second connector housing 3.

The first connector housing 1 includes a rectangular-shaped front housing member 7 of an insulating synthetic resin having front and rear ends 7*a* and 7*b*, and a rear holder 8 of an insulating synthetic resin fitted to the rear end of the front housing member 7. The front housing member 7 is provided with an upper wall 7*c*, a lower wall 7*d*, side walls 7*e* joining the upper and lower walls 7*c* and 7*d*, and an intermediate body portion 9 which is formed at an intermediate position somewhat displaced towards the rear end 7*b*, whereby a front hollow portion 10 of a considerable depth is defined at its front portion while a rear hollow portion 11 of a relatively small depth is defined at its rear end. The intermediate body portion 9 includes a main portion 9*a* having a plurality of apertures 12 formed therethrough, and a pair of right and left vertical walls 9*b* integrally formed on top of the main portion 9*a* to define an opening 13 therebetween for accommodating the short-circuiting element 5. A pair of parallel slits 14 are formed in the upper surface of the main portion 9*a* so as to be communicated with two of the adjacent apertures 12 while a saddle portion 9*c* is integrally formed on the upper surface of the main portion 9*a* so as to be positioned between the slits 14, whereby a pair of guide spacings 13*a* communicated with the slits 14 are defined at opposite sides of the saddle portion 9*c*. In addition, a pair of guide brackets 15 of a generally L-shaped cross-section are formed integrally on the inner face of the upper wall 7*c* in vertically opposed relation to the slits 14. Furthermore, a pair of engaging tongues 7*f* are integrally formed on the side walls 7*e* of the housing member 7 at its rear end 7*b*, whereas a pair of longitudinally extending parallel guide plates 7*g* are integrally formed on the inner surface of the lower wall of the front hollow portion 10 of the housing member 7.

The rear holder 8, which is fitted in the rear hollow portion 11 of the housing member 7, includes a rectangular body portion 8*a* having a plurality of holes 16 formed therethrough for accommodating the male electric terminals 2, and a plurality of elongated engaging fingers 8*b* each formed integrally on the body portion 8*a* so as to extend from a position adjacent to a respective hole 16. A pair of engaging recesses 8*c* are formed at side walls of the body portion 8*a*, and the rear holder 8 is secured to the front housing member 7 with the engaging recesses 8*c* being fitted on the engaging tongues 7*f*, in such a manner that the holes 16 of the rear holder 8 are aligned with the apertures 12 of the housing member 7, respectively, and the engaging fingers 8*b* are inserted in the apertures 12. As best shown in FIG. 2B, the male electric terminals 2, which are inserted through the holes 16 of the rear holder 8, are further inserted through the apertures 12 of the front housing member 7, respectively, and secured to the housing member 7 with their engaging protrusions 2*a* being mated with engaging recesses 9*d* formed in the main portion 9*a*, and with their intermediate portions 2*b* being pressed by the engaging fingers 8*b* which are bent towards the terminals 2 by the shoulder portions formed in the apertures 12 of the intermediate body portion 9. Moreover, as schematically shown in FIG. 2B, a detecting device D is connected to at least one of the two male terminals 2 for detecting electric current in the short-circuiting element 5.

The second connector housing 3 also includes a rectangular-shaped front housing member 17 of an insulating synthetic resin having front and rear ends 17*a* and 17*b*, and a rear holder 18 of an insulating synthetic resin fitted to the front housing member 17 at its rear end 17*b*. The front housing member 17 is dimensioned to be smaller than the housing member 7 of the first connector housing 1 so that it is fitted in the forward hollow portion 10 of the housing member 7 of the first connector housing 1. The housing member 17 is provided with a plurality of apertures 19 formed therethrough, and a pair of elongated guide frames 20 formed on the upper face thereof to define a pair of first guide grooves 21 at the outer side of the frames 20. The central portion disposed between the guide frames 20 is provided with a front portion 22 having a plurality of shallow grooves 22*a* formed therein, and a rear shoulder portion 23 having an aperture of a generally circular cross-section formed therein and defining a pair of upwardly-opening second guide grooves 23*b* at the opposite sides thereof. In addition, a pair of parallel slits opening in the forward and downward direction of the housing member 17 are formed in the bottom of the housing member 17, and the housing member 17 is adapted to be fitted in the first connector housing 1 with the parallel guide plates 7*g* of the first connector housing 1 being fitted in the parallel slits for sliding movement therealong.

The rear holder 18, which is fitted in the housing member 17, includes a rectangular body portion 18*a* having a plurality of holes 24 formed therethrough for accommodating the female electric terminals 4, respectively, and a plurality of elongate ed engaging fingers 18*b* each formed integrally on the body portion 18*a* so as to extend from a position adjacent to a respective aperture 19. A pair of engaging tongues 18*c* are formed at the side walls of the body portion 18*a*, and the rear holder 18 is secured to the front housing member 17 with the engaging tongues 18*c* being engaged with engaging holes 17*c* formed in the side walls of the housing member 17, in such a manner that the holes 24 of the rear holder 18 are aligned with the apertures 19 of the housing member 17, respectively, and the engaging fingers 18*b* are inserted in the apertures 19. As shown in FIG. 2B, the female electric terminals 4, which are inserted through the holes 24 of the rear holder 18, are further inserted through the apertures 19 of the front housing member 17, respectively, and are secured to the housing member 17 with their front bent portions 4*a* being engaged with protrusions 17*d* formed on the inner walls of the apertures 19, and with their intermediate portions 4*b* being pressed by the engaging fingers 18*b* which are bent towards the terminals 4 by the shoulder portions formed in the apertures 19 of the housing member 17.

The short-circuiting element 5 accommodated in the first connector housing 1 comprises an elongated leaf spring of a suitable resilient metal bent at its longitudinally intermediate portion and having a flat bearing portion 5*a* at one longitudinal end. A longitudinally extending slit 5*b* is formed in the other end portion of the leaf spring to provide a pair of branched contact portions 5*c* which are further bent at right angles in a direction away from the one end to provide edges serving as a pair of thin contacts 5*d*. Further, that portion from which the slit 5*b* extends is bent outward to provide a convexly bent portion 5*e*. The short-circuiting element 5 is accommodated in the first connector housing 1 with opposite sides of the flat bearing portion 5*a* being housed in the guide brackets 15 and with the contact portions 5*c* being placed on the saddle portion 9*c* to permit the contacts 5*d* to be directed downward. Thus, the two contacts 5*d* are adapted to come in contact with the adjacent two male terminals 2, respectively, and the convexly-bent portion 5*e* is positioned so that it protrudes downward.

The lock-confirming sliding element 6, which is arranged on the second connector housing 3, comprises a pair of right and left wing portions 25 of a channel shaped cross-section disposed apart from each other so as to open in the downward direction, and an intermediate portion 26 joining together the wing portions 25, each wing portion having an outer plate portion 25*a* accommodated in a respective first guide groove 21. The intermediate portion 26 is provided with a front tongue 26*a* adapted to be placed on the front portion 22 of the housing member 17 and having an abutting portion 26*b* protruding forward therefrom, and a rear portion 26*c* having a pair of downwardly protruding guide portions 26*d* adapted to be received in the guide grooves 23*b*, respectively, and having an integral rod portion 26*e* formed between the guide portions 26*d* so as to extend in the rearward direction thereof and adapted to be fitted in the aperture 23*a* for sliding movement therealong. Thus, the sliding element 6 is slidably arranged on the second connector housing 3, with the guide portions 26*d* being respectively housed in the second guide grooves 23*b* while the plate portions 25*a* are respectively housed in the first guide grooves 21, and with the front tongue 26*a* being placed on the front portion 22. Although not shown, a stopper protrusion engageable with an engaging recess formed in the front housing member 17 is formed on the sliding element 6 so that the sliding element 6 is prevented from being disengaged from the front housing member 17.

An urging element in the form of a compression coil spring 27 having a prescribed spring constant is disposed around the rod portion 26*e*, with one end being held in contact with the inner end wall from which the rod portion 26 extends, and with the other end being held in contact with the inner end surface of the rear shoulder portion 23 of the housing member 17 of the second connector housing 3. Thus, the coil spring 27 acts between the sliding element 6 and the second connector housing 3 to urge the sliding element 6 in the direction forward from the second connector housing 3.

Furthermore, a pair of right and left engaging arms 28, which are resiliently deformable in a direction towards and away from each other, are formed on the upper portion of the intermediate body portion 9 of the first connector housing 1 so as to protrude into the front hollow portion 10. The engaging arms 28 have engaging protrusions 28*a* formed at their free ends so as to face each other. Each of the first guide grooves 21 of the housing member 17 of the second connector housing 3, which are arranged in transversely spaced relation to each other, is defined by inner and outer side walls 21*a* and 21*b* disposed in parallel and opposed relation to each other, and by a bottom 21*c* joining the side walls 21*a*and 21*b*. The outer side wall 21*b* is formed to be flat so that the outer plate portion 25*a* of a respective wing portion 25 of the sliding element 6 can be guided therealong, whereas the inner side wall 21*a*is provided with a flat wall portion 29*a* formed in parallel and opposed relation to the outer side wall 21*b* and a stepped wall portion 29*b* formed adjacent to a front end thereof and protruding towards the outer side wall 21*b* so as to define a flat top surface. Thus, the stepped wall portion 29*b* is adapted to abut the engaging protrusion 28*a* of a respective engaging arm 28 to resiliently deform the engaging arm 28, while the flat wall portion 29*a* as well as a shoulder portion 29*c* connecting the flat wall portion 29*a* and the stepped wall portion 29*b* define an engaging portion 29 with which the engaging protrusion 28*a* is held in engagement when the engaging arm 28 is restored to its released position.

Figure 2A:
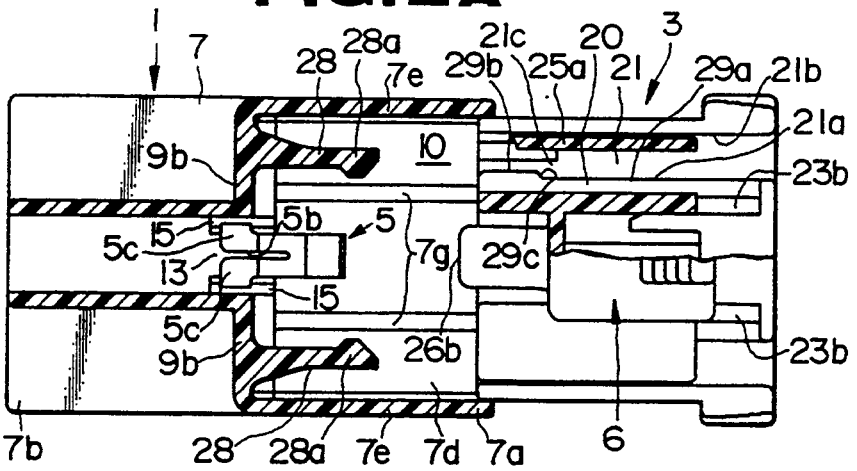
FIG. 2A is a partially cut-away plan view of the electrical connector of FIG. 1, showing the state prior to the completion of the fitting of the connector housings.
Figure 2B:
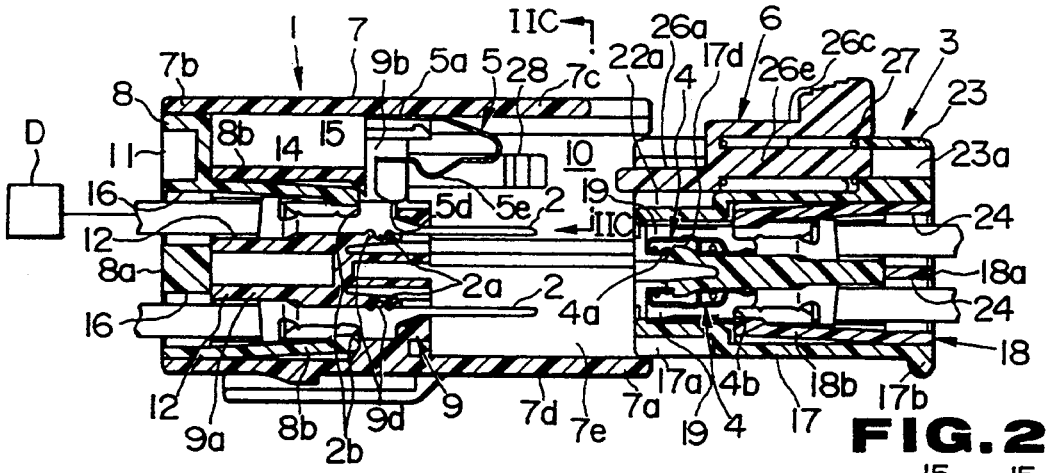
FIG. 2B is a cross-sectional view of the electrical connector of FIG. 2A.
Figure 2C:
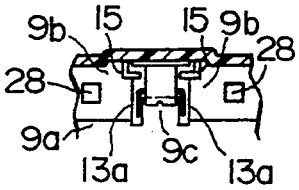
FIG. 2C is a view of a part of the electrical connector of FIG. 1, as seen in the direction indicated by the arrows IIC—IIC in FIG. 2B.

In operation, FIGS. 2A and 2B depict a state where the second connector housing 3 begins to be inserted in the first connector housing 1. In this state, the male and female electric terminals 2 and 4 are out of electrical contact with each other, whereas the short-circuiting element 5 is in a short-circuited state where the short-circuiting element 5 is held in contact with the two male terminals 2 to connect the two terminals 2. In addition, the engaging arms 28 are not yet inserted in the second connector housing 3.

Figure 3A:
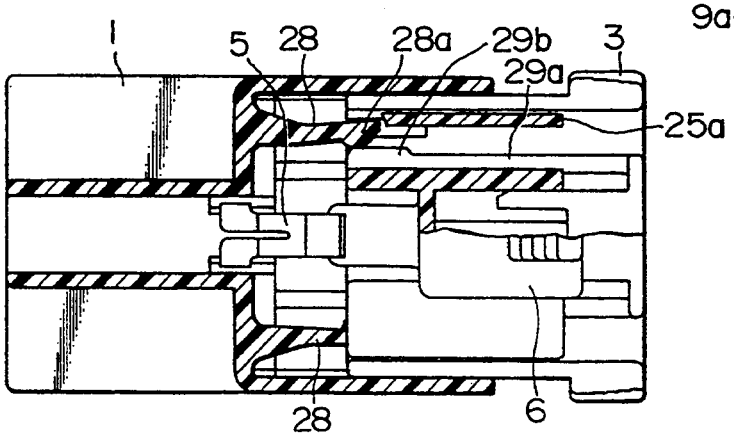
FIG. 3A is a view similar to FIG. 2A, but showing the state in which the fitting of the connector housings is further proceeded.
Figure 3B:
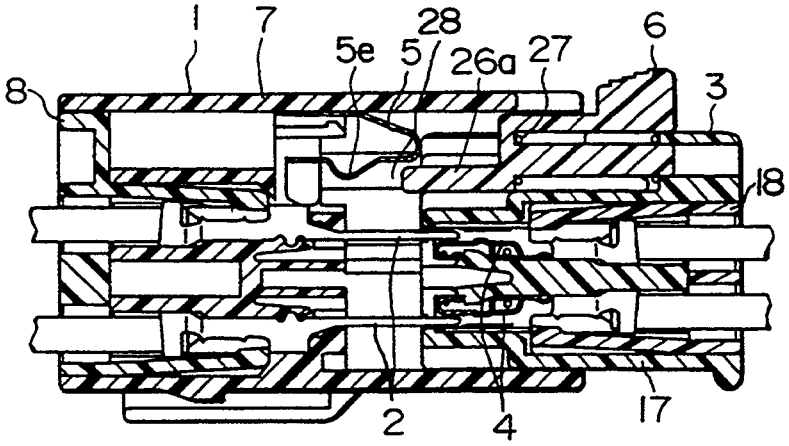
FIG. 3B is a view similar to FIG. 2B, showing the same state as that in FIG. 3A.

When the fitting operation of the connector housings 1 and 3 is further proceeded as shown in FIGS. 3A and 3B, the engaging protrusions 28*a* of the engaging arms 28 are brought into contacting abutment with the stepped wall portions 29*b* to be resiliently deformed outwardly in a direction perpendicular to the fitting direction, and due to this resilient deformation, the engaging arms 28 are brought into the paths of the guide grooves 21 through which the outer plate portions 25*a* of the wing portions 25 slide. Even in this state, the male and female electric terminals 2 and 4 are still out of electrical contact with each other, whereas the short-circuiting element 5 is in electrical contact with the male terminals 2. Additionally, the engaging protrusions 28*a* of the engaging arms 28 have not yet arrived at the engaging portions 29.

Figure 4A:
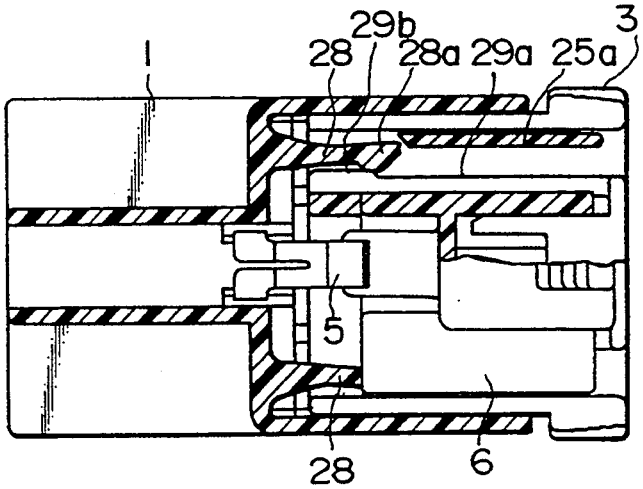
FIG. 4A is a view similar to FIG. 3A, but showing the state in which the fitting of the connector housings is further proceeded.
Figure 4B:
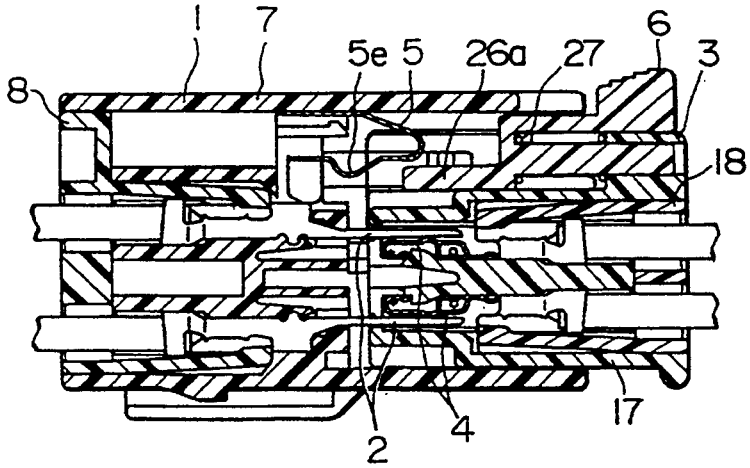
FIG. 4B is a view similar to FIG. 3B, showing the same state as that in FIG. 4A.

FIGS. 4A and 4B depict a state where the fitting operation is further proceeded. In this state, the engaging arms 28 are brought into contact with the outer plate portions 25*a* of the wing portions 25 of the sliding element 6, and as a result, the sliding element 6 is caused to move in the rearward direction against the resilient force of the coil spring 27. In this state, the male and female electric terminals 2 and 4 are in electrical contact with each other although the short-circuiting element 15 is still in electrical contact with the male terminals 2. The engaging protrusions 28*a* of the engaging arms 28 are still deformed and have not yet arrived at the engaging portions 29.

Figure 5A:
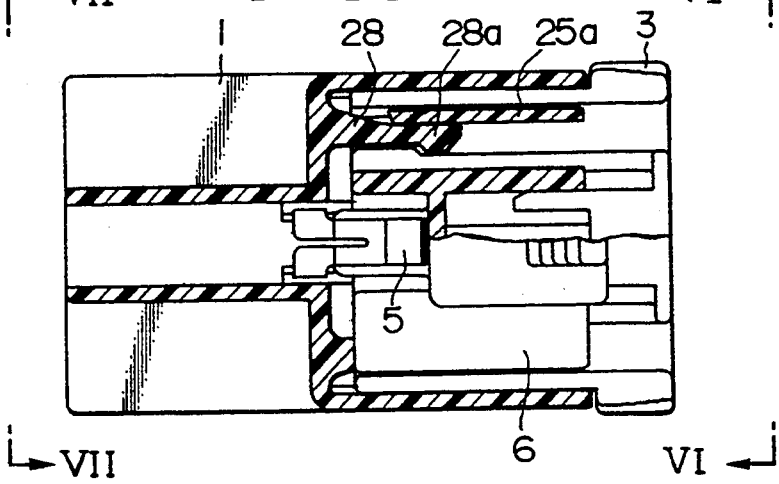
FIG. 5A is a view similar to FIG. 4A, but showing the state in which the fitting of the connector housings is completed.
Figure 5B:
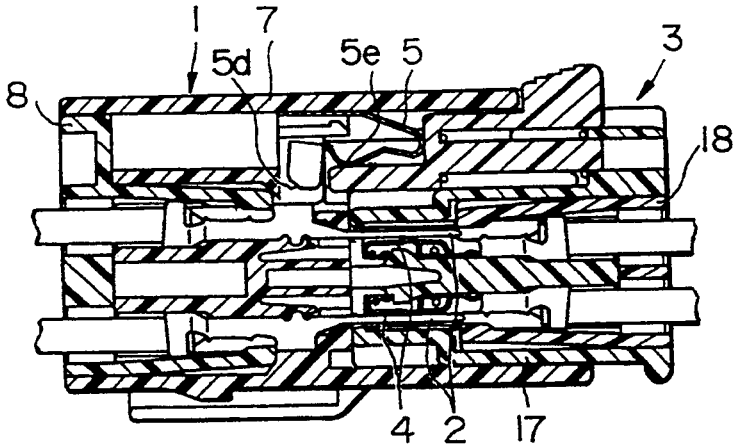
FIG. 5B is a view similar to FIG. 4B, showing the same state as that in FIG. 5A.
Figure 6:
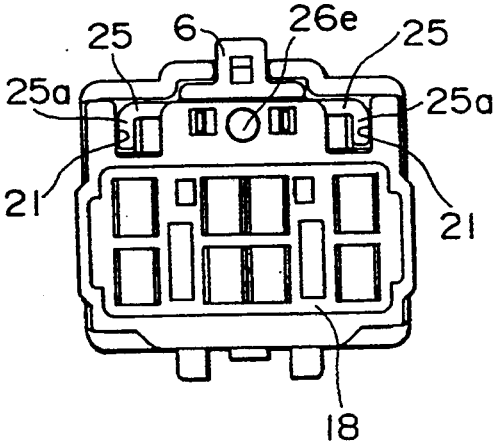
FIG. 6 is a side view of the electrical connector of FIG. 1 as seen in the direction indicated by the arrows VI—VI in FIG. 5A.
Figure 7:
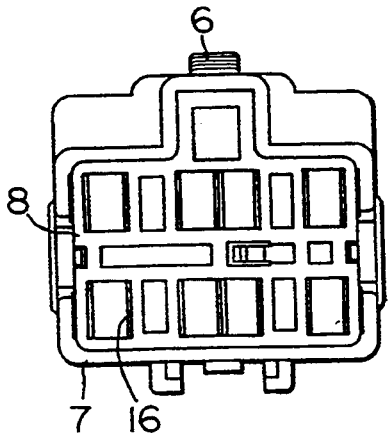
FIG. 7 is a side view of the electrical connector of FIG. 1 as seen in the direction indicated by the arrows VII—VII in FIG. 5A.
Figure 9:
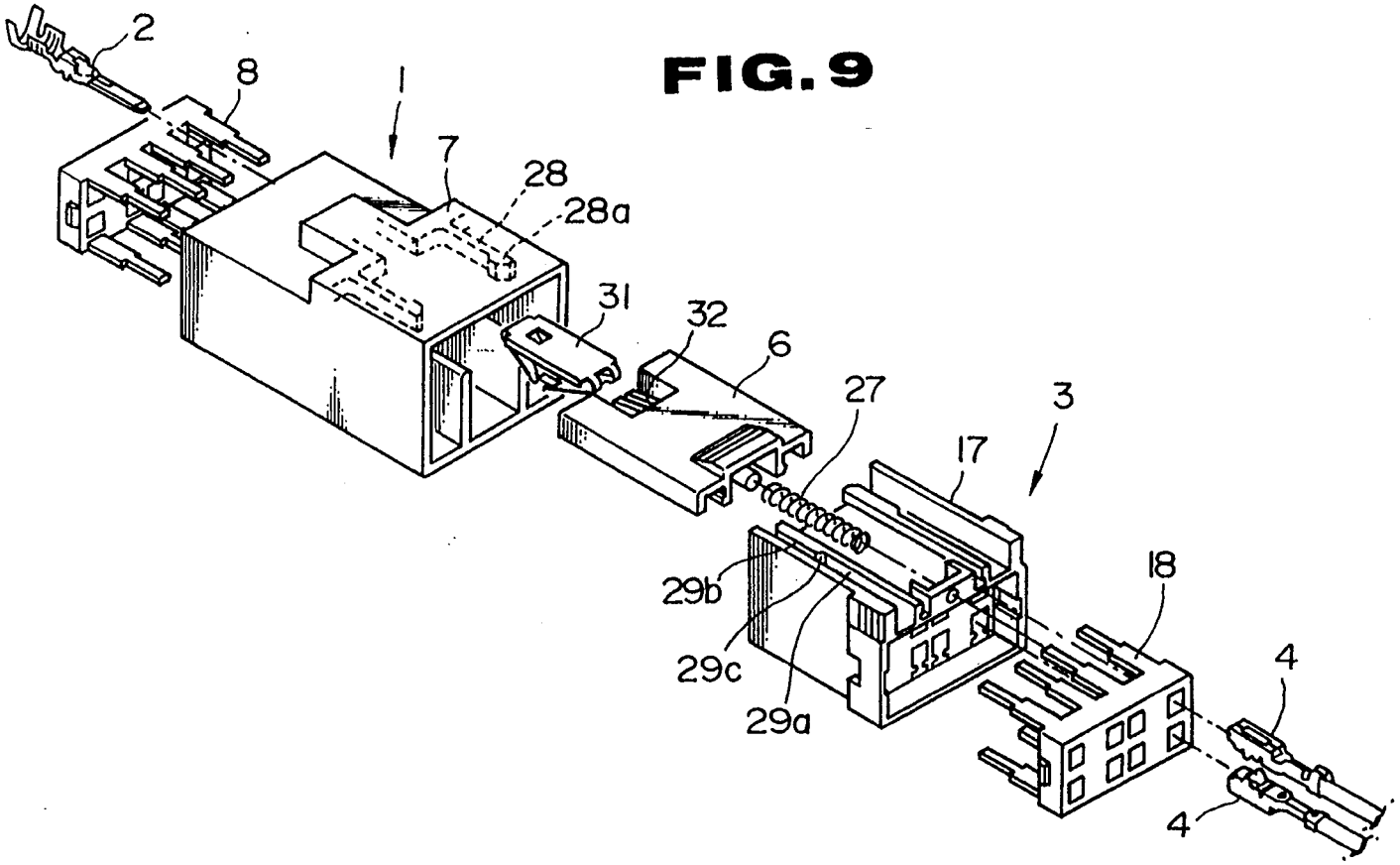
FIG. 9 is a perspective view similar to FIG. 1, but showing a modified electrical connector in accordance with the invention.
Figure 10A:
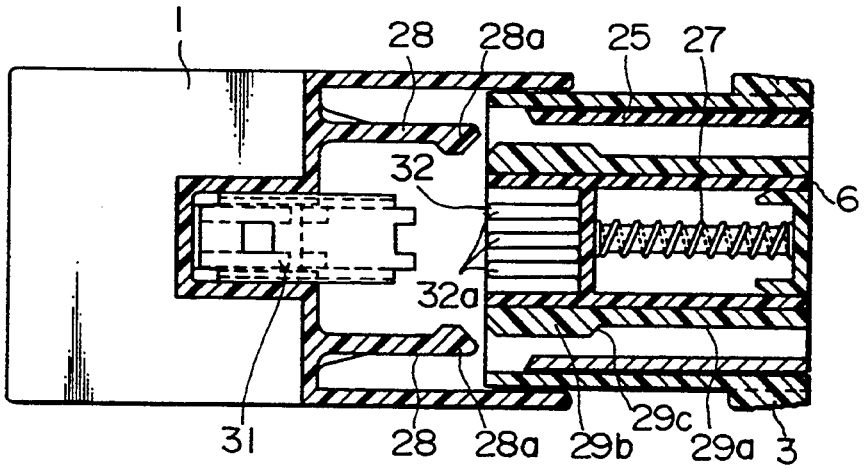
FIG. 10A is a partially cut-away plan view of the electrical connector of FIG. 9, showing the state prior to the completion of the fitting of the connector housings.
Figure 10B:
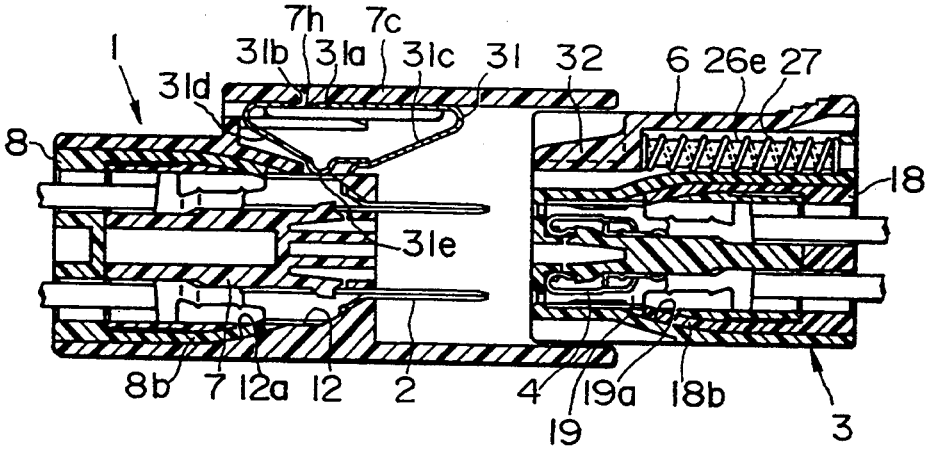
FIG. 10B is a cross-sectional view of the electrical connector of FIG. 10A.

When the fitting operation is further carried out as shown in FIGS. 5A and 5B, the engaging arms 28, which are resiliently deformed by the stepped wall portion 29*b* while pressing the sliding element 6 backwards, are restored to their original released positions, so that the engaging protrusions 28*a* are retracted from the moving path of the wing portions 25 and brought into engagement with the engaging portions 29. As a result, because no obstacles to the movement of the wing portions 25 exist in the first guide grooves 21, the sliding element 6 is urged by the coil spring 27 and moved in a forward direction towards the first connector housing 1. As the sliding element 6 moves forwards, the abutting portion 26*b* of the sliding element 6 is brought into abutting engagement with the convexly-bent portion 5*e* of the short-circuiting element 5 to deform the same in a direction away from the two male electric terminals 2, so that the short-circuiting element 5 is electrically disconnected from the adjacent two male electric terminals 2. More specifically, in the state shown in FIGS. 4A and 4B, the male and female electric terminals 2 and 4 are held in electrical contact with each other, whereas the short-circuiting element 5 is disconnected from the two male electric terminals 2. In addition, the engaging protrusions 28*a* of the engaging arms 28 are fitted in the guide grooves 21 and held engagement with the engaging portions 29 thereof, respectively.

In the foregoing, electricity is, in advance, turned on between the two male electric terminals 2 and the short-circuiting element 5, and checked by the detecting unit D which is connected to at least one of the two male terminals 2, and when the electric current is not sensed by the detecting unit D, it is detected or confirmed that the short-circuiting element 5 is disconnected from the male electric terminals 2. More specifically, when the first and second connector housings 1 and 3 are completely fitted to each other with the engaging arms 28 being accommodated in the guide grooves 21 and with the engaging protrusions 28*a* being engaged with the engaging portions 29, the sliding element 6 is permitted to move forward by the urging force of the coil spring 27 because the engaging arms 28 are disengaged from the sliding element 6, and the abutting portion 26*b* thereof is brought into pressing contact with the convexly-bent portion 5*e* of the short-circuiting element 5, whereby the short-circuiting element 5 is deformed upwardly and disconnected from the two male electric terminals 2.

Accordingly, only when the fitting of the first and second connector housings 1 and 3 is completed, is the disconnection of the short-circuiting element 5 detected by the detecting device, and the fitting operation is proceeded until the disconnection of the short-circuiting element 5 is detected. Therefore, any incomplete fitting of the connector housings 1 and 3 can be avoided with certainty, and only when the fitting of the connector housings 1 and 3 is completed, can a signal indicating the connection of the male and female terminals 2 and 4 be generated to achieve higher reliability of the connector.

In addition, in the aforesaid electrical connector, the fitting of the first and second connector housings 1 and 3 is incomplete until the engaging protrusion 28*a* of the engaging arms 28 are received by the engaging portions 29 of the guide grooves 21 of the second connector housing 3, and at the moment the engaging portions 28*a* of the engaging arms 28 are brought into engagement with the engaging portions 29 of the guide grooves 21, the completion of the fitting of the connector housings 1 and 3 can then be detected. Therefore, the fitting operation is prevented from being stopped at a time when the fitting is not actually completed.

As described above, in the electrical connector in accordance with the present invention, the fitting of the connector housings 1 and 3 is related to the engagement of the engaging arms 28 with the guide grooves 21, and is detected by the use of the short-circuiting element 5 and the sliding element 6 which is moved in association with the engagement of the engaging arms 28. Accordingly, the electrical connector of the present invention achieves high reliability, and can be used in apparatuses which require reliability of a higher level. For example, it can be successfully used to connect electric cables to transmit actuating signals in an air bag system of an automobile for the protection of the drivers.

Obviously, many modifications and variations of the present invention are possible in light of the above teachings. For example, as shown in FIG. 8, the short-circuiting element 5 may be comprised of a torsional spring 30 of a suitable resilient metal formed so as to include a channel-shaped bearing portion 30*a*, a pair of coil portions 30*b*, a pair of convexly-bent portions 30*c* protruding downward, and a pair of leg portions 30*d* extending from and bending perpendicular to the bent portions 30*c*, and a pair of looped ends 30*e* disposed at free ends of the convexly-bent portions 30*c* so as to serve as a pair of thin contacts. The short-circuiting element 5 is accommodated in the first connector housing 1 with the bearing portion 30*a* being housed in the guide brackets 15 and with the convexly-bent portions 30*c* being placed on the saddle portion 9*c* to permit the thin contacts to be directed downward. Thus, the thin contacts are adapted to come in contact with the adjacent two male terminals 2, respectively, and the convexly-bent portions 30*c* are positioned so that they protrude downward.

Figure 11A:
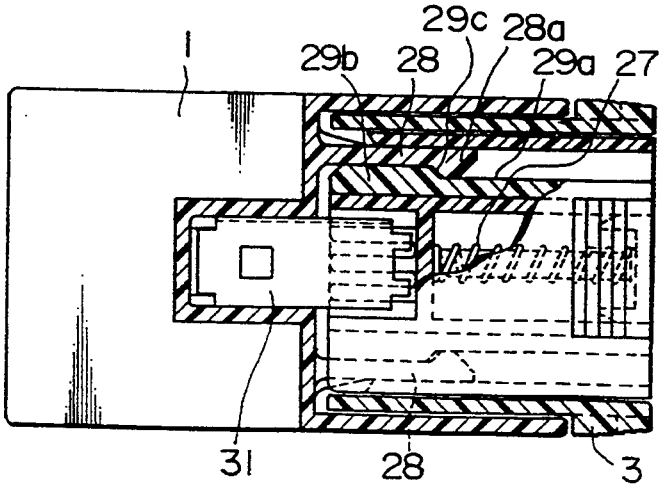
FIG. 11A is a view similar to FIG. 10A, but showing the state in which the fitting of the connector housings is completed.
Figure 11B:
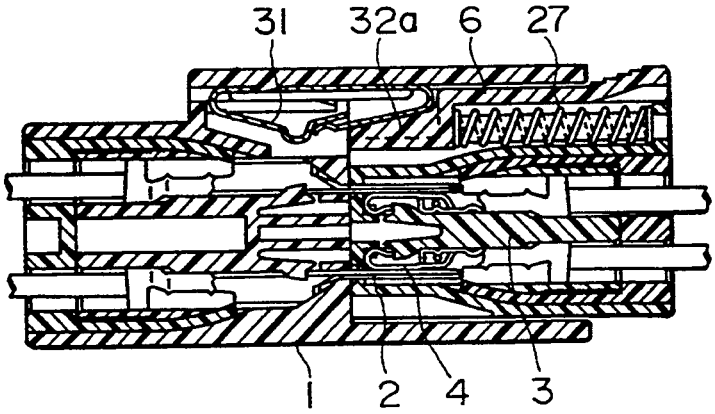
FIG. 11B is a view similar to FIG. 10B, showing the same state as that in FIG. 11A.
Figure 12:
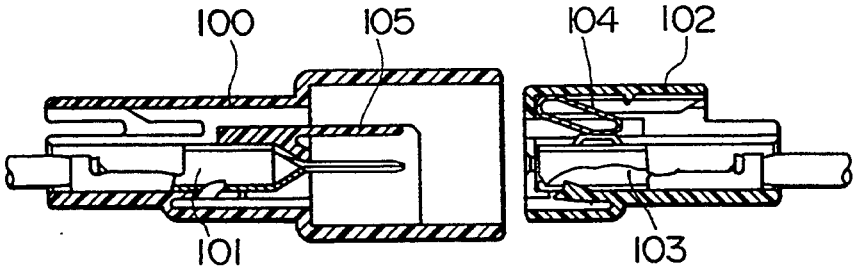
FIG.12 (PRIOR ART)
FIG. 12 is a cross-sectional view of a conventional electrical connector.

Furthermore, FIGS. 9 to 11B depict a modified electrical connector in accordance with the present invention, in which the same numerals as in the previous embodiment are used to designate common parts or members. The electrical connector shown in this embodiment is basically similar to that of the previous embodiment, but the short-circuiting element is comprised of a looped leaf spring. More specifically, the short-circuiting element, designated by 31, includes a flat base portion 31*a*having a through opening 31*b*, a pair of front leaf portions 31*c* extending and bending acutely from the base portion 31*a*, and a rear leaf portion 31*d* extending and bending acutely from the base portion 31*a*. The rear leaf portion 31*d* is provided with a convexly-bent protrusion 31*e* which serves as an electric contact to be in contact with the two male terminals 2, whereas the front leaf portions 31*c* are held in abutting contact with the end of the rear leaf portion 31*d*. As best shown in FIG. 10B, the short-circuiting element 5 is accommodated in the first connector housing 1 with the opening 31*b* being fitted on a protrusion 7*h* formed on the upper wall 7*c* of the first connector housing 1 in such a manner that the protrusion 31*e* serving as the electric contact is adapted to come in contact with the two male electric terminals 2. Furthermore, the sliding element 6 is provided with a front tongue 32 having a plurality of elongated protrusions 32*a* sloping forward and downward thereof, and the outer pair of the protrusions 32*a* are adapted to come in contact with the front leaf portions 31*c*, respectively, to deform the short-circuiting element 31 away from the male terminals 2. FIGS. 11A and 11B depict a state in which the short-circuiting element 31 is disconnected from the male terminals 2. As best shown in FIG. 11B, the inclined surfaces of the protrusions 32*a* are entirely held in contact with the front leaf portions 31*c* to completely disengage the short-circuiting element 31 from the male terminals 2. Additionally, in this embodiment, the apertures 12 and 19 of the connector housings 1 and 3 are formed so as to have curved walls 12*a* and 19*a*, and the engaging fingers 8*b* and 18*b* of the rear holders 8 and 18 are deformed by the curved walls 12*a* and 19*a* towards the terminals 2 and 4 to secure the same.

Moreover, although in the illustrated embodiments, the sliding element 6 as well as the engaging members 28 are formed of insulating synthetic resins, they may be formed of a conductive material such as metal. Furthermore, the coil spring 27 may be formed so as to have a greater spring constant such that when the fitting of the first and second connector housings 1 and 3 is incomplete, the second connector housing 3 is pushed outwards in a direction away from the first connector housing 1. With this construction, when the fitting of the connector housings is incomplete, the connector housings are automatically separated from each other. Additionally, the first connector housing may be formed so as to hold the female terminals and the second connector housing may be formed for holding the male terminals.

Finally, the present application claims the priority of the Japanese Patent Application No. 4-198835 filed on Jul. 24, 1992, which is incorporated herein by reference.

What is claimed is:

1. An electrical connector comprising:

a first connector housing for holding a plurality of first electric terminals, said first connector housing having front and rear ends and including at least one resiliently-deformable engaging arm provided thereon so as to extend forward thereof, said engaging arm having an engaging protrusion at a forward end thereof;

a second connector housing for holding a plurality of second electric terminals, said second connector housing having front and rear ends and being releasably fitted to said first connector housing with said second terminals being held in electrical contact with said first terminals, respectively, said second connector housing including at least one first guide groove formed therein for receiving said engaging arm, said first guide groove having an engaging portion with which said engaging protrusion is held in engagement and a stepped wall portion formed adjacent to said front end of said second connector housing;

a short-circuiting element accommodated in said first connector housing in electrical contact with at least two of said first terminals to connect said two first terminals;

a sliding element arranged on said second connector housing so as to be slidable forward and rearward of said second connector housing, said sliding element having a front tongue engageable with said short-circuiting element to disengage said short-circuiting element from said two first terminals; and an urging element disposed between said sliding element and said second connector housing for urging said sliding element in a direction forward from said second connector housing;

wherein said engaging arm and said first guide groove are constructed so that upon fitting of said first and second connector housings, said engaging arm is resiliently deformed by said stepped wall portion of said first guide groove to be brought into abutment with said sliding element to thereby move said sliding element towards said rear end of said second connector housing, whereas upon completion of the fitting of said first and second connector housings, said engaging arm is restored to a released position where said engaging protrusion is held in engagement with said engaging portion of said first guide groove, while permitting said sliding element to move forward of said second connector housing.

2. An electrical connector as defined in claim 1, further comprising a detecting unit connected to at least one of said two first terminals for detecting electric current in said short-circuiting element.

3. An electrical connector as defined in claim 1, wherein said first connector housing includes a pair of said engaging arms arranged generally parallel to each other with said engaging protrusions being directed to each other, whereas said second connector housing includes a pair of said first guide grooves arranged generally parallel to each other.

4. An electrical connector as defined in claim 3, wherein said sliding element includes a pair of wing portions each having an outer plate portion accommodated in a respective first guide groove for sliding movement therealong, whereby upon the fitting of said first and second connector housings, the forward end of a respective engaging arm is brought into abutment with said plate portion of a respective wing portion.

5. An electrical connector as defined in claim 4, wherein said second connector housing includes a pair of second guide grooves formed in an upper face thereof, said sliding element including a pair of guide portions received in said second guide grooves for sliding movement therealong.

6. An electrical connector as defined in claim 1, wherein said second connector housing includes an aperture formed therein so as to extend in a sliding direction thereof, said sliding element including a rod portion disposed in alignment with said aperture, said urging element being comprised of a coil spring disposed around said rod portion and accommodated in said aperture, said coil spring being fixedly secured at opposite ends to said second connector housing and said sliding element, respectively.

7. An electrical connector as defined in claim 1, wherein said short-circuiting element includes a convexly-bent portion and a pair of contacts held in electrical contact with said two first terminals, said short-circuiting element being arranged so that when said connector housings are fitted with each other, said front tongue of said sliding element is brought into abutting engagement with said convexly-bent portion to move said contacts away from said two first terminals.

8. An electrical connector as defined in claim 7, wherein each of said first and second connector housings includes a front housing member having front and rear ends, and a rear holder fitted to said front housing member at its rear end.

9. An electrical connector as defined in claim 8, wherein said housing member of said first connector includes a body portion having a plurality of apertures formed therethrough for accommodating said first terminals and a pair of slits formed therein for permitting said pair of contacts of said short-circuiting element to come in contact with said two first terminals.

10. An electrical connector as defined in claim 9, wherein said short-circuiting element is comprised of a leaf spring.

11. An electrical connector as defined in claim 9, wherein said short-circuiting element is comprised of a torsional spring.

12. An electrical connector as defined in claim 1, wherein said short-circuiting element includes a convexly-bent portion and a front portion held in contact with said sliding element, said convexly-bent portion serving as a contact held in electrical contact with said two first terminals, said short-circuiting element being arranged so that when said connector housings are fitted with each other, said front tongue is brought into abutting engagement with said front portion to move said contact away from said two first terminals.

* * * * *